US006664721B1

(12) United States Patent
Jamison et al.

(10) Patent No.: US 6,664,721 B1
(45) Date of Patent: Dec. 16, 2003

(54) GATED ELECTRON FIELD EMITTER HAVING AN INTERLAYER

(75) Inventors: Keith D. Jamison, Austin, TX (US); Donald E. Patterson, Pearland, TX (US); Charlie Hong, Austin, TX (US); Randolph D. Schueller, Austin, TX (US); David F. Hebert, Austin, TX (US); Richard L. Woodin, Austin, TX (US)

(73) Assignee: Extreme Devices Incorporated, Austin, TX (US)

( * ) Notice: Subject to any disclaimer, the term of this patent is extended or adjusted under 35 U.S.C. 154(b) by 271 days.

(21) Appl. No.: 09/684,107

(22) Filed: Oct. 6, 2000

(51) Int. Cl.[7] ..... H01J 1/02
(52) U.S. Cl. ..... 313/309; 313/326; 313/351
(58) Field of Search ..... 313/309, 326, 313/336, 351, 346 R, 495–497; 438/20

(56) References Cited

U.S. PATENT DOCUMENTS 4,964,946 A 10/1990 Gray et al. ..... 156/643
5,401,676 A 3/1995 Lee ..... 437/200
6,031,250 A * 2/2000 Brandes et al. ..... 257/77
6,297,587 B1 * 10/2001 Kikuchi et al. ..... 313/495
6,417,606 B1 * 7/2002 Nakamoto et al. ..... 313/336

OTHER PUBLICATIONS

Kim, et al., "Fabrication of silicon field emitters by forming porous silicon," Journal of Vacuum Science and Technology: Part B, vol. 14, No. 3: pp. 1906–1909, 1996.

* cited by examiner

*Primary Examiner*—Robert H. Kim
*Assistant Examiner*—Jurie Yun
(74) *Attorney, Agent, or Firm*—Baker Botts L.L.P.

(57) ABSTRACT

A field emitter (10) having improved electron emission properties is provided. Electron-emitting microtip protrusions (14) in an emitter layer (12) are separated from a dielectric layer (18) by an interlayer (16) that prevents substantial mixing of the dielectric (16) and the emitter layer (12) during growth of the dielectric layer (18). A conductive gate electrode layer (20) is deposited on the dielectric layer (18). For carbon-based emitters, aluminum is one of several suitable interlayers between the carbon layer and a silicon dioxide dielectric layer.

13 Claims, 8 Drawing Sheets

GATED ELECTRON FIELD EMITTER HAVING AN INTERLAYER

TECHNICAL FIELD OF THE DISCLOSURE

The present disclosure relates in general to electron field emitters and, more particularly, to a method and system for improved electron field emission with an interlayer between the emitting material and a dielectric layer.

BACKGROUND

Gated field emitter arrays show promise for use in many electronic products including electron guns for cathode ray tubes used in computer monitors and other display devices. One method of manufacturing gated field emitter arrays uses a process that includes deposition of dielectrics and metals on the emitter material then etching back portions of the deposited materials around the protrusions or tips where electron emission occurs. For example, a wafer of an emitter material such as $sp^2$ and $sp^3$ bonded carbon can be formed with microtips on the wafer surface. Such emitters are described in co-pending and commonly assigned patent applications Ser. No. 09/169,908 and Ser. No. 09/169,909, which are hereby incorporated by reference herein. A conventional deposition tool such as a sputter deposition system or a plasma enhanced chemical vapor deposition (PECVD) can then deposit a conformal dielectric film on the wafer. One such dielectric is silicon dioxide ($SiO_2$). A thin conductive gate layer is then deposited on top of the dielectric film. To form the gate holes with this process an aluminum hard mask is sputter deposited on the gate layer. Next, a layer of photoresist is deposited on the emitter/dielectric/gate layer/hard mask stack using a spinner so that the resist is thinner above the microtips than elsewhere across the wafer.

After depositing the layers, selective ion etching can be used to thin the photoresist such that the thin photoresist, in the area above the microtips, is completely removed. The thicker photoresist on the wafer between the microtips is thinned, but not removed. The surface is then exposed to a chemical etchant that removes the hard mask and conductive gate layer in the areas where the photoresist has been removed, i.e., over the microtips. A combination of conventional wet chemical etch and dry etch techniques can then be used to remove the exposed dielectric from the tips and then the remaining photoresist and hard mask to form the gated structure.

Using the gate-forming scheme described above, conventional dielectrics like silicon nitride and silicon dioxide can intermix with the emitter material during dielectric deposition. For example, during sputtering of the dielectric layer, silicon dioxide can intermix with the carbon atoms that form the emitter material. This intermixed layer may remain during the etch step that forms the gate, thereby changing the emission properties of the emitter material. If the intermixed layer is too thick it may significantly increase the electric field necessary for electron emission, detrimentally affecting the performance of the device. An example of the result of intermixing is shown in FIG. 1.

FIG. 1 illustrates the performance difference between emitter tips before dielectric deposition and after dielectric deposition and sebsequent dielectric removal with buffered hydroflouric acid (BHF). Clean carbon tips, formed by process described and claimed in co-pending and commonly assigned patent application Ser. No. 09/169,909, filed Oct. 12, 1998, which is hereby incorporated by reference herein, were used to obtain the data in curve 6 of FIG. 1. Using well known techniques, an electrically conducting ball having a large radius compared to the tips array size was lowered over the surface of the tips and voltage applied to obtain emission current at different values of applied voltage. Curve 6 of FIG. 1 illustrates diode emission current that results from a range of electric fields across an ungated microtip array of carbon tips. Curve 8 illustrates the experimental relationship between electric field and emission current for carbon tips after silicon dioxide had been sputter deposited at 400 watts of RF power and then etched away with buffered hydrofluoric acid. The electric field required to obtain high levels of emission current is more than doubled for the carbon emitter after formation and removal of the silicon dioxide layer.

When intermixing occurs between the emitter material and the dielectric layer, there is need for a structure and method of manufacturing that will decrease or eliminate the negative effects of an intermixed layer.

SUMMARY OF THE INVENTION

A system and method for separating a dielectric layer and a field emitter with an interlayer. None of the advantages disclosed, by itself, is critical or necessary to the disclosure.

A disclosed system includes a field emitter layer having a plurality of microtips. Attached to the field emitter layer is an interlayer. The interlayer contains openings above at least a majority of the microtips. The interlayer material adheres well to the emitting material without significant intermixing. A dielectric layer is deposited on the interlayer on the opposite side from the field emitter layer and contains openings above at least a majority of the microtips. A conductive gate layer is deposited on the dielectric layer on the other side from the interlayer. The conductive gate layer has openings above at least a majority of the microtips.

A more specific system is also provided in which the field emitter layer is formed of a carbon-based material, the dielectric is formed of silicon dioxide, and the interlayer is formed of aluminum. As an alternative the interlayer could be formed of another metal, including but not limited to gold or platinum.

A more specific system is also provided in which the interlayer can be selectively etched without etching the dielectric layer, the field emitter layer, or the conductive gate layer.

A method is provided for forming an improved electron emitter by separating a dielectric and a field emitter with an interlayer. A wafer of a field emitter material, having a plurality of protrusions extending from a planar surface, is provided. An interlayer material is deposited on the wafer. A dielectric material is then deposited on the interlayer material. A conductive gate layer is then deposited on the dielectric layer. A hard mask is then deposited on the conductive gate layer. A photoresist layer is spun on the hard mask layer such that the photoresist layer is thinner above the wafer protrusions than elsewhere. The photoresist layer is etched through its thinner, but not thicker, areas. The exposed layers above the protrusions are etched in sequence to expose at least the tops of the protrusions on the surface of the wafer.

A more specific method is also provided in which the step of depositing the interlayer comprises sputter depositing aluminum at a deposition power of between 790 and 810 watts for between 20 and 30 seconds in 2–5 millitorr of argon.

It is a technical advantage of the disclosed systems and methods that electrons can be emitted from the ends of the microtips or protrusions of the field emitter layer at lower values of electric field.

It is also a technical advantage of the disclosed systems and methods that the microtips or protrusions maintain their initial emission characteristics after deposition and etching of other layers.

Another technical advantage of the systems and methods disclosed is that any stresses (thermal, mechanical etc.) between the emitter material and the dielectric layer are more effectively managed by the stress relaxation properties of the interlayer.

Other technical advantages of the present disclosure will be readily apparent to one skilled in the art from the following figures, descriptions, and claims. Various embodiments of the invention obtain only a subset of the advantages set forth. No one advantage is critical to the invention. For example, one embodiment of the present invention may only provide the advantage of emitting electrons from the microtips or protrusions of the field emitter layer, while other embodiments may provide several of the specified and apparent advantages.

BRIEF DESCRIPTION OF THE DRAWINGS

A more complete understanding of the present disclosure and advantages thereof may be acquired by referring to the following description taken in conjunction with the accompanying drawings, in which like reference numbers indicate like features, and wherein.

DETAILED DESCRIPTION OF THE DISCLOSURE

Figure 1:
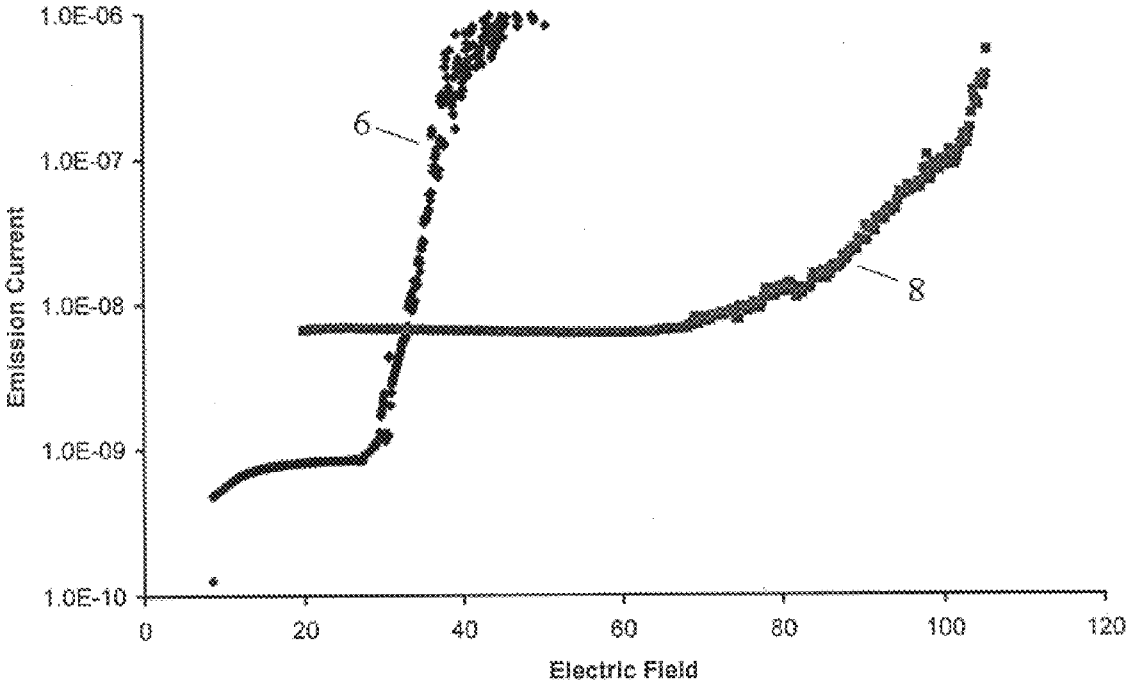
FIG. 1 is a graph of diode emission currents resulting from a range of electric fields.
Figure 2:
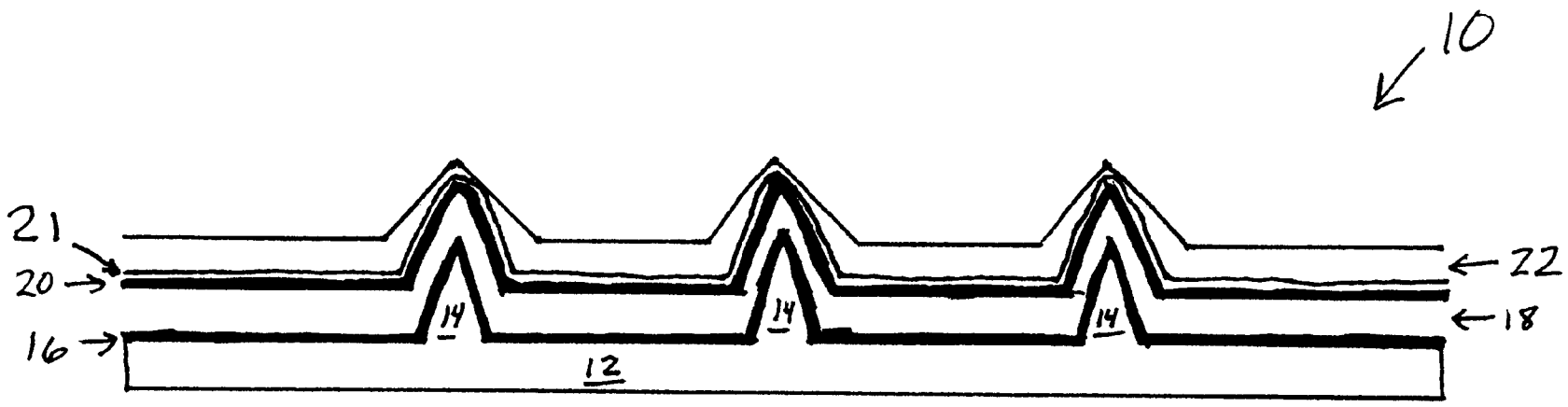
FIG. 2 is a cross-sectional view of a manufacturing stage of a system according to one embodiment of the present invention.

FIG. 2 shows a cross-sectional view of a manufacturing stage of a system according to one embodiment of the present invention. A gated field emitter 10 includes a field emitter layer 12 having protrusions 14. The protrusions 14 can be microtips and can be of various sizes and shapes. The protrusions 14 extend from a substantially planar surface of a wafer of field emitter material. In one embodiment, as shown in the figure, the protrusions form a point at the end. In one embodiment, the protrusions 14 are formed of the same material as the rest of the field emitter layer 12. A material that can be used to form the field emitter layer 12 and protrusions 14 in one embodiment of the present disclosure is a carbon-based field emitter, such as disclosed in Ser. Nos. 09/169,908 and 09/169,909. Other field emitter materials such as silicon and gallium nitride can also be used. Although carbon emitters were used to obtain results included herein, the methods of using an interlayer, as disclosed herein, may be applied to any field emitter-dielectric layers that form an intermixed layer that can decrease emission current from the field emitter after removal of the dielectric layer. The applicability of the method of forming an interlayer for any emitter-dielectric combination can be determined by results of measurements such as depicted in FIG. 1.

An interlayer 16 is positioned adjacent the field emitter layer 12, including the protrusions or microtips 14. In another embodiment, the interlayer 16 is positioned above only the protrusions. The interlayer 16 adheres to the field emitter layer 12. In one embodiment, the adhesive strength of the interlayer to the field emitter layer 12 is at least 2 $kg/cm^2$, as measured by a standard adhesion measurement device. The interlayer 16 does not combine with the field emitter layer 12 over more than a few atomic layers. In one embodiment, the combination of the two layers 12 and 16 is confined to a region in layer 12 less than 30 Angstroms into layer 12. In one embodiment, the interlayer 16 is a metal. In a more specific embodiment, the interlayer 16 is a metal that does not form carbides at temperatures below 500° C. In more specific embodiments, the interlayer 16 is gold, platinum, or aluminum.

In one embodiment, the interlayer 16 can be added to a clean field emitter layer using magnetron sputtering. In that embodiment, the deposition power, pressure and duration would be set in order to achieve the desired thickness of the interlayer.

For example, in one embodiment the deposition tool could be employed to deposit aluminum with a deposition power of between 790–810 watts at 2–5 millitorr for a time period of between 20 and 30 seconds to achieve an interlayer 16 with a thickness of about 100 nanometers.

The interlayer 16 thickness can be varied. In one embodiment the thickness is between 10 and 200 nanometers. In one embodiment, the interlayer 16 is etchable with a process that does not etch the other layers. This process is called selective etching. For example, with an aluminum interlayer, a phosphoric acid ($H_3PO_4$) solution can be used that will not disturb a carbon-based emitter material, a silicon dioxide dielectric, or a molybdenum gate layer.

A dielectric layer 18 is positioned adjacent to the interlayer 16 on the opposite side from the field emitter layer 12. The dielectric layer 18 covers the interlayer 16 both in the areas between the protrusions 14 and the areas above the protrusions 14. In an embodiment where the interlayer covers only the protrusions 14, the dielectric layer 18 covers the field emitter layer 12 between the protrusions 14. Vertical directions are assumed from the figures, though the system need not be oriented vertically either for manufacture or use. The dielectric layer 18 is attached to the interlayer 16. In one embodiment, the adhesive strength of the bond between the interlayer 16 and the dielectric layer 18 is at least 2 $kg/cm^2$. The adhesive strength can be measured as detailed above. In one embodiment, the dielectric layer is formed of silicon dioxide ($SiO_2$). Another embodiment includes a silicon nitride dielectric layer 18. In one embodiment, the dielectric layer 18 is added to a field emitter layer 12 with an interlayer 16 using a conventional sputter deposition process.

A conductive gate layer 20 is deposited on the dielectric layer 18. The conductive gate layer 20 covers the dielectric layer 18 both in the areas between the protrusions 14 and the areas above the protrusions 14. In one embodiment, the conductive gate layer 20 is a metal. In a more specific embodiment, the conductive gate layer 20 is molybdenum. In one embodiment, the conductive gate layer 20 is added above the dielectric layer 18 using conventional sputter deposition methods. In one embodiment, the conductive gate layer 20 is thinner than the dielectric layer 18.

Additionally, a hard mask layer 21 can be added above the conductive gate layer 20. This layer can be used as a hard mask for subsequent fabrication steps and/or as a contact layer making electrical attachment to the gate layer. The hard mask layer 21 covers the conductive gate layer 20 both in the areas between the protrusions 14 and the areas above the protrusions 14. In one embodiment, the hard mask layer 21 is a metal. In a more specific embodiment, the hard mask layer 21 is added above the conductive gate layer 20 using conventional sputter deposition techniques.

A photoresist layer 22 is deposited on the hard mask layer 21. The photoresist layer 22 covers the hard mask layer 21 both in the areas between the protrusions 14 and the areas above the protrusions 14. In one embodiment, the photoresist layer 22 is thinner in areas above the protrusions 14 than in areas between the protrusions 14. In one embodiment, the photoresist layer 22 is conventionally spun-on on top of the conductive gate layer 20. In another embodiment, the spin-on process is done at such a speed to cause the photoresist layer 22 to be thinner in the areas above the protrusions 14 than elsewhere.

Figure 3:
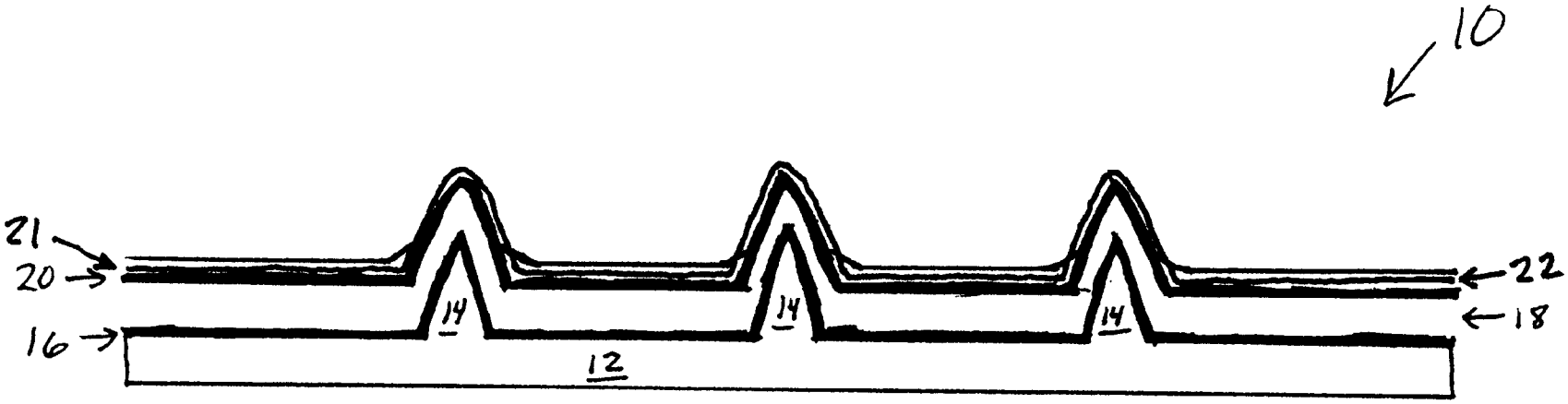
FIG. 3 is a cross-sectional view of a manufacturing stage of a system according to one embodiment of the present invention.

FIG. 3 is a cross-sectional view of a manufacturing stage of a system according to one embodiment of the present invention. The photoresist layer 22 has been removed from the areas above the protrusions 14. In one embodiment, the photoresist layer 22 is thinner above the protrusions 14 and an even removal of that layer 22, for example using a conventional reactive ion etch, thins the photoresist layer 22 between the protrusions 14 and completely removes it above the protrusions 14. In another embodiment, a photomask is used to develop the photoresist layer 22 only in the areas above the protrusions 14. The developed photoresist layer 22 is removed using conventional resist development techniques. The resulting gated field emitter 10 has the hard mask layer 21 exposed above the protrusions 14 and the photoresist layer 22 as the top layer between the protrusions 14.

Figure 4:
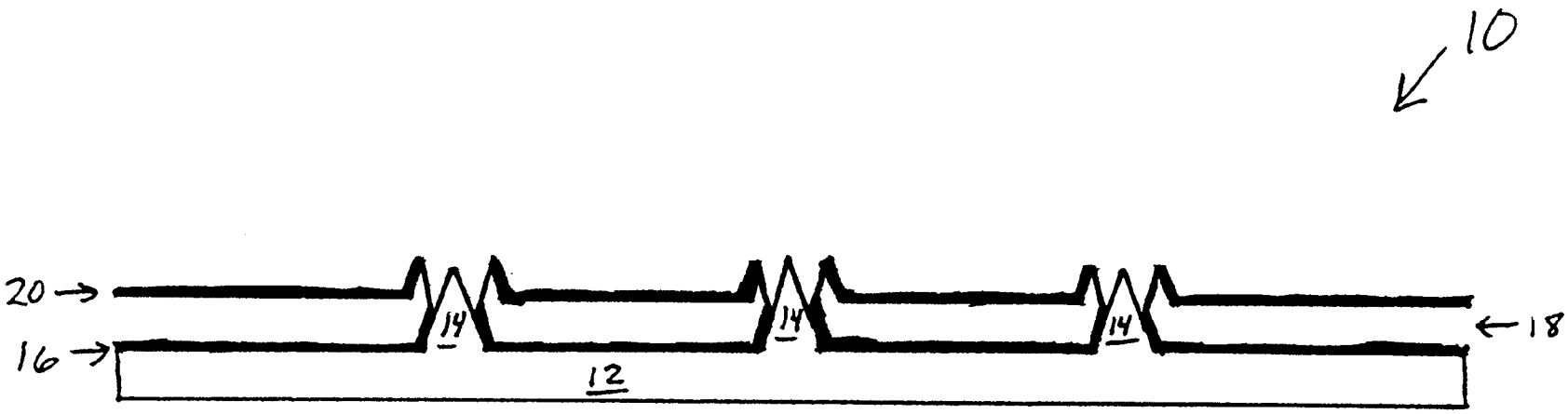
FIG. 4 is a cross-sectional view of a system according to one embodiment of the present invention.

FIG. 4 is a cross-sectional view of a system according to one embodiment of the present invention. The gated field emitter 10 has uncovered protrusions 14 of the field emitter layer 12. In one embodiment, conventional etching methods are used to remove the exposed hard mask layer 21, while not affecting the photoresist layer 22. Because the hard mask layer 21 is exposed from beneath the photoresist layer 22 only above the protrusions 14, only that portion is removed. In one embodiment, one or more conventional dry or wet etching processes are then used to remove the conductive gate layer 20, the dielectric layer 18 and interlayer 16, while the photoresist layer 22 and/or the hard mask layer 21 protects the rest of the gated field emitter 10 from being etched. Once the protrusions 14 are uncovered, the remaining photoresist layer 22 and/or hard mask layer 21 can be removed. Additionally, the hard mask layer 21 may also be removed using standard etching techniques. In another embodiment, the hard mask layer may be photolithographically defined and etched to leave contact pads on the surface. The field emission device then has interlayer 16 surrounding the protrusions, dielectric layer 18 surrounding the protrusions and conductive gate layer 20 surrounding and spaced apart from the protrusions. Although it is intended that each and every protrusion have the interlayer, dielectric and gate as described herein, it is recognized that manufacturing processes may prevent perfect structures as depicted in the figures. Some protrusions and gates may not be effective emitters, although it is expected that a majority of the protrusions and gates will have properties as illustrated herein.

Figure 5:
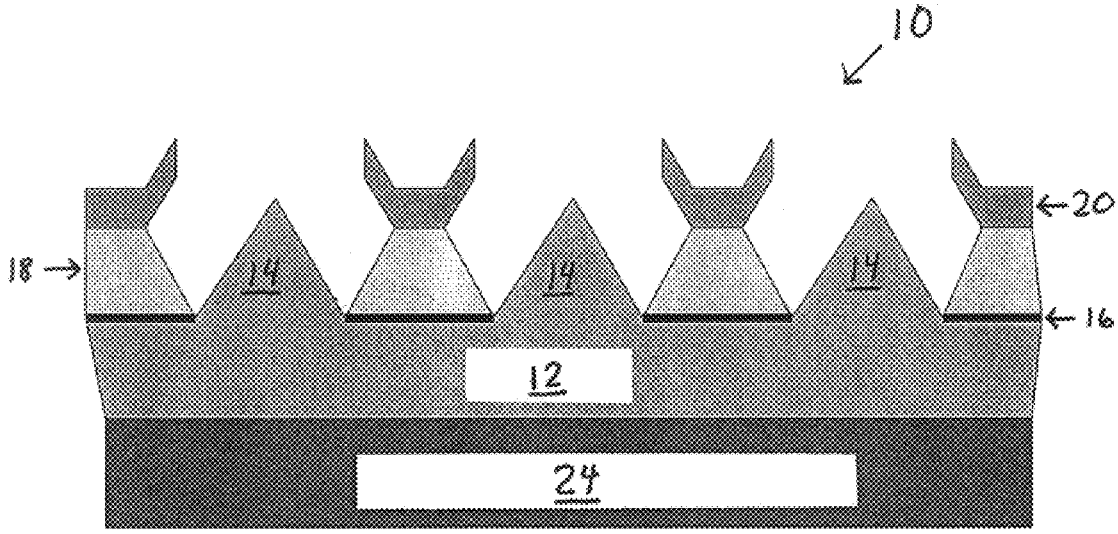
FIG. 5 is a cross-section view of a gated field emitter array according to one embodiment of the present invention.

FIG. 5 is a cross-section view of a gated field emitter array according to one embodiment of the present invention. The gated field emitter 10 in this embodiment has a similar layer structure to that shown in FIG. 4; however, the ratio of horizontal distance between the protrusions 14 to the width of protrusions 14 is less and the ratio of layer thicknesses is also different. Other configurations varying the proportions of protrusion spacing, protrusion openings, dielectric layer thickness, and conductive gate layer thickness are also contemplated.

Figure 6:
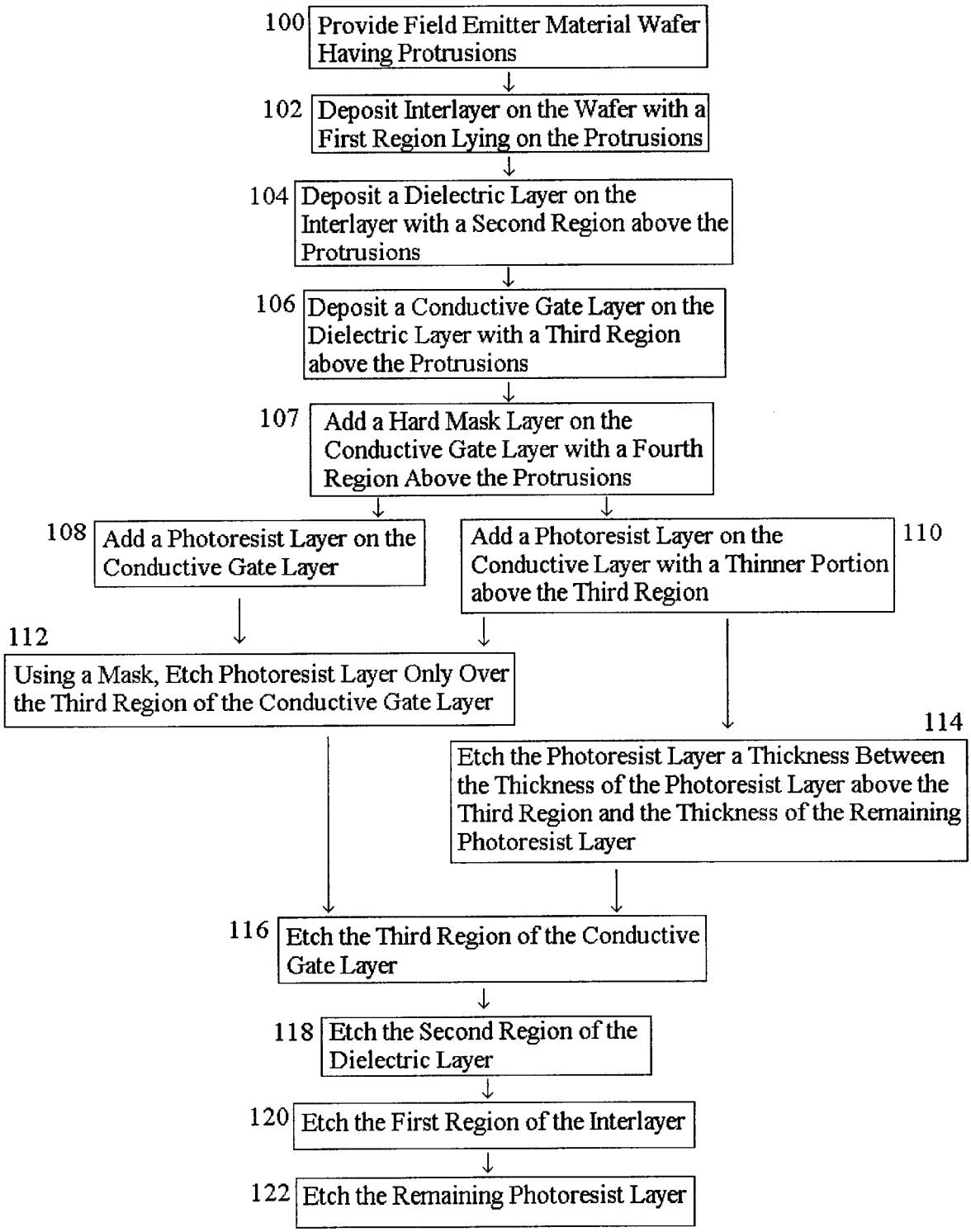
FIG. 6 is a flow chart of a method according to one embodiment of the present invention.

FIG. 6 is a flow chart of a method according to one embodiment of the present invention. In step 100 a wafer formed of field emitter material is provided. The wafer has protrusions extending from its surface. In step 102 an interlayer is deposited on the wafer. In step 104 a dielectric layer is deposited on the. In step 106 a conductive gate layer is deposited on the dielectric layer. In step 107 a hard mask layer is added. In step 108 a photoresist layer is spun-on on top of the conductive gate layer. In one embodiment, step 110 is performed as a more specific form of step 108. The photoresist layer is spun-on on top of the conductive gate layer with varying thickness. A thinner layer above the protrusions and a thicker layer between the protrusions. In step 112 the photoresist layer is developed using conventional photoresist development and strip techniques to expose the conductive gate layer above the protrusions. Step 112 can be taken after either step 108 or step 110. In step 114 the photoresist layer is etched a uniform thickness that exposes the conductive gate layer above the protrusions. In one embodiment, step 114 can only be employed after step 110. In step 116 conductive gate layer above the protrusions is etched. In step 118 the dielectric layer above the protrusions is etched. In step 120 the interlayer above the protrusions is etched. In step 122 the remaining portions of the photoresist layer are removed.

EXAMPLE 1

Figure 7:
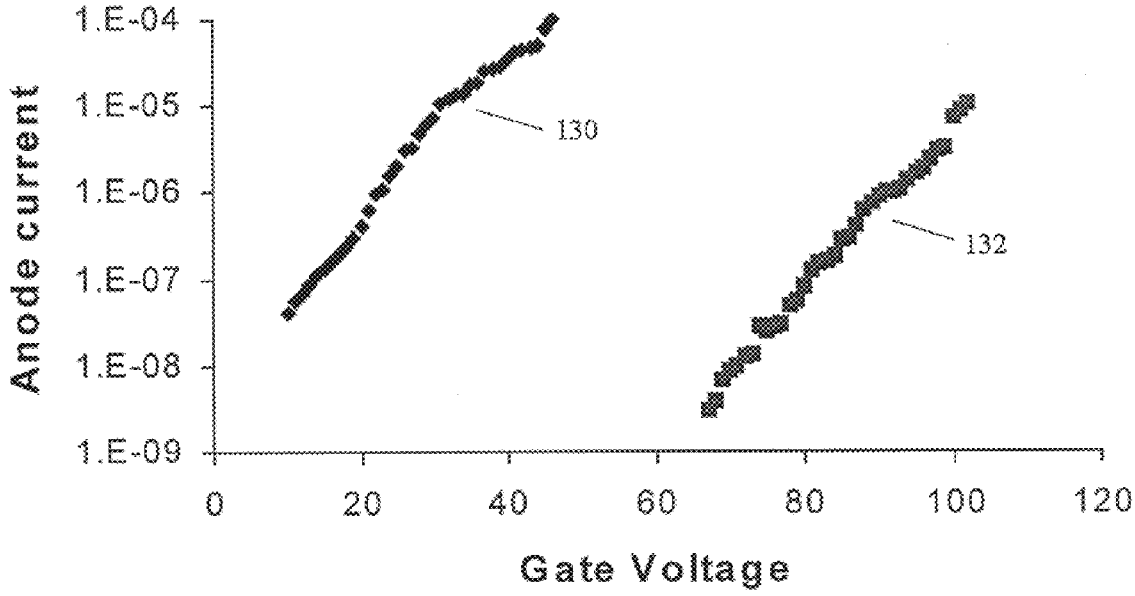
FIG. 7 is a graph of electrical current of gated field emitter arrays with and without an interlayer.

FIG. 7 is a graph of anode current of gated field emitter arrays with and without an interlayer. The performance of the device can vary depending on the emitter material used and on the etching steps. Carbon emitters from different substrates were used in the two experiments depicted in FIG. 7, although it is expected that their properties were similar.

To obtain the data represented by curve 130 in FIG. 7, the carbon emitters were coated with an aluminum interlayer according to the methods disclosed herein before deposition of the silicon dioxide dielectric and molybdenum electrode layers and etching to form a gated device. To obtain the data represented by curve 132, deposition of the interlayer was omitted. The gate voltage to obtain the same values of anode current was 2–3 times as large for the device not having the interlayer.

EXAMPLE 2

Figure 8:
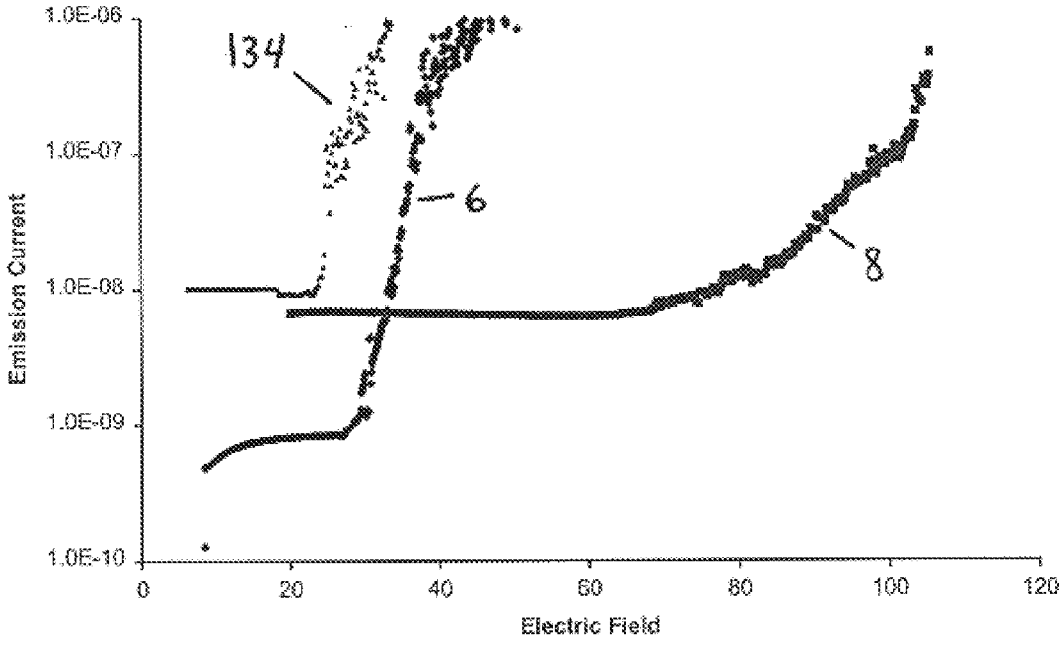
FIG. 8 is a graph of diode emission currents from differently formulated diodes resulting from a range of electric fields.

FIG. 8 is a graph of diode emission currents from differently formulated diodes resulting from a range of electric fields. The two curves 6,8 shown from FIG. 1 are graphed with a third curve 134 formed from additional data corresponding to one embodiment of the present invention. The data forming curve 134 was obtained for a carbon emitter diode after deposition and etching off a silicon dioxide layer when an aluminum interlayer was present between the carbon and silicon dioxide. The aluminum interlayer can prevent the degradation of emission properties of the carbon emitter after deposition and etching of the dielectric layer. As a result, curve 134 shows variation in emission current at a lower voltage than curve 8, where deposition and etching occurred without an interlayer.

Although embodiments of the present disclosure have been described in detail, it should be understood that various changes, substitutions and alterations can be made thereto without departing from the spirit and scope of the invention as defined by the appended claims.

What is claimed is:

1. A system for field emission comprising:

a field emitter layer having a plurality of microtip protrusions;

a metal interlayer on the field emitter layer, the interlayer being around each of a majority of the microtips in the field emitter layer;

a dielectric layer on the metal interlayer, the dielectric layer being around each of a majority of the microtips in the field emitter layer, and a conductive gate layer on the dielectric layer, the conductive gate layer being around and spaced apart from each of a majority of the microtips in the field emitter layer.

2. The system of claim 1 wherein the metal interlayer is combined with the field emitter layer over a distance of less than 30 angstroms.

3. The system of claim 1, wherein the metal interlayer is bonded to the field emitter layer with an adhesive strength of at least 2 $kg/cm^2$.

4. The system of claim 1, wherein the dielectric layer is bonded to the metal interlayer with an adhesive strength of at least 2 $kg/cm^2$.

5. The system of claim 1, wherein the field emitter layer is formed of a carbon-based material.

6. The system of claim 1, wherein the dielectric layer is formed of silicon dioxide.

7. The system of claim 1, wherein the metal interlayer is formed of aluminum, gold, or platinum.

8. The system of claim 7, wherein the metal interlayer is formed of aluminum.

9. The system of claim 1, wherein the metal interlayer has an average thickness between 10 and 100 nanometers.

10. The system of claim 1, wherein the metal interlayer can be selectively etched.

11. The system of claim 1, wherein the plurality of microtips are arranged in an array.

12. The system of claim 1, wherein the conductive gate layer is formed of metal.

13. The system of claim 12, wherein the conductive gate layer is formed of molybdenum.

* * * * *